US006272997B1

(12) United States Patent
James et al.

(10) Patent No.: US 6,272,997 B1
(45) Date of Patent: Aug. 14, 2001

(54) DEVICE FOR LOCATING A PROJECTILE IN A BARREL

(75) Inventors: David J James, Nottingham; Derrick Hewkin, Bristol, both of (GB)

(73) Assignee: Royal Ordnance PLC, Lancashire (GB)

( * ) Notice: Subject to any disclaimer, the term of this patent is extended or adjusted under 35 U.S.C. 154(b) by 0 days.

(21) Appl. No.: 09/488,577

(22) Filed: Jan. 21, 2000

(51) Int. Cl.[7] ..... F42B 30/08

(52) U.S. Cl. ..... 102/293; 102/372; 102/374; 102/439; 102/520

(58) Field of Search ..... 102/293, 372, 102/374, 439, 520.23; 89/1.806–1.808, 1.55; 244/3.25–3.29

(56) References Cited

U.S. PATENT DOCUMENTS

| | | | |
|---|---|---|---|
| 3,610,092 | | 10/1971 | Miller . |
| 3,978,792 | * | 9/1976 | Campoli et al. . |
| 4,175,720 | * | 11/1979 | Craig . |
| 5,503,080 | * | 4/1996 | Goward et al. . |

FOREIGN PATENT DOCUMENTS

| | | | |
|---|---|---|---|
| 0651224 A1 | * | 3/1995 | (EP) . |
| 0 651 224 | | 5/1995 | (EP) . |
| 1 515 243 | | 5/1968 | (FR) . |
| 2 260 390 | | 4/1999 | (GB) . |

* cited by examiner

*Primary Examiner*—Charles T. Jordan
*Assistant Examiner*—Troy Chambers
(74) *Attorney, Agent, or Firm*—Nixon & Vanderhye P.C.

(57) ABSTRACT

A retaining clip for the retention of a fin-stabilised projectile in a desired position in a barrel at the rear breech end of a launcher, the clip comprising a generally cylindrical body portion having:

engagement means for engaging with the launcher at the said rear breech end, said engagement means extending at least part of the way around the said cylindrical body portion and adapted to prevent forward movement of the clip when positioned in the launcher, a substantially central axial aperture for allowing access for firing the projectile a plurality of radially and axially extending grooves for engaging the fins of the projectile when the clip is fitted to the projectile, each of said grooves having facing walls defining the groove therebetween, and the grooves adapted to divide the cylindrical body portion into a plurality of connected segments locating means positioned on at least one of said walls of at least one of said grooves and intruding into or above the groove, said locating means adapted to engage positively at least one of the fins of the projectile to prevent the projectile from readily slipping out of the clip when the clip is fitted to the projectile.

27 Claims, 3 Drawing Sheets

DEVICE FOR LOCATING A PROJECTILE IN A BARREL

The present invention relates to a clip device for locating a fin stabilised projectile axially in the barrel of a launcher and preventing the projectile from slipping forwards when the muzzle of the barrel is depressed.

It is operationally desirable to fire the projectile at both relatively high angles of elevation and relatively low angles of depression of the barrel. Throughout the range of angles required for operation of the launcher it is necessary to ensure that the projectile is positioned such that the firing pin is able to reach and ignite the propellant charge. Our published patent application number WO93/07439 describes a breech loading mortar system having means for preventing a round of ammunition from slipping backwards after being loaded when the barrel is at a relatively high angle of elevation. Equally important is the need to prevent the projectile from sliding forwards after loading and prior to firing when the muzzle of the barrel is at a relatively low angle of depression.

Our European Patent EP0651224 which is incorporated herein by reference attempts to overcome the problems associated with projectiles sliding forwards in the barrel of a launcher at relatively low angles of depression of the barrel by disclosing a clip for retaining a round of ammunition in a desired position in the barrel of the launcher. This clip is cylindrical, with grooves extending in radial and axial directions, the grooves designed to engage the fins of a projectile. The clip and the round of ammunition are loaded together into the breech of the launcher, the engaged fins of the round of ammunition being prevented from sliding out of the grooves in the clip by the frictional resistance between the clip and the fins. The clip also has a rim extending circumferentially around its back edge, at the opposite axial end to the grooves, which is designed to allow the clip to engage with a recess at the breech end of the launcher to prevent forward movement of the clip. In this manner the round of ammunition is held in a desired position for firing and is not able to slide forward down the barrel of the launcher even at low angles of depression. The clip is made from a thermosetting plastics material which is hard, strong and rigid such that it can engage the fins and not deform under the intense heat and pressure of firing.

The clip disclosed in EP0651224 relies on the frictional forces between the walls of the grooves of the clip and the fins of the projectile being sufficient to prevent the projectile from sliding away from the clip and the firing pin at low angles of depression. Frictional forces rely on the material used for the fins and the clip as well as the tolerances of the fins and the grooves. If the fins are slightly thicker than desired they may not fit in the grooves of the clip, alternatively if the fins are slightly thinner than desired or the grooves slightly wider the frictional forces between the clip and the fins may not be sufficient to prevent the projectile from sliding away from the clip before or during firing. It is extremely difficult and expensive to ensure that each projectile has fins manufactured within a very narrow tolerance band suitable for producing an interference fit giving the necessary level of frictional resistance. Additionally, this clip may not be suitable for use over the range of angles generally demanded during launch. At low angles of elevation or low angles of depression, for example in the range +5 to −5 degrees to the horizontal, where increasingly greater frictional resistance is required to prevent the projectile from sliding, this clip can result in mis-firings where the projectile has slid away from the firing pin before firing. This is extremely dangerous in terms of operational efficiency and safety of personnel, as mis-fired projectiles may launch a considerable time after being fired, sometimes in the order of several minutes afterwards. Additionally, at higher angles of barrel elevation the clip may be itself inclined to slide backwards in the barrel if the frictional resistance between the clip and the barrel is not great enough, which can also result in mis-firings or blocking the breech.

It has also been found that when the breech is closed, the force of closing the breech can cause the projectile to be knocked out of the clip disclosed in EP0651224.

Dependence on an extremely tight interference fit to provide sufficient friction can be a serious drawback, due to the difficulties associated with consistently manufacturing fins and clips to the required tolerances, and can result in a higher than desirable number of mis-firings.

Additionally it has been found that the inflexible hard plastics material used may shatter when exposed to the extremely high pressure forces experienced during firing. The grooves in the clip encourage stresses to gather at the tips of the grooves, and if the material is hard and inflexible the clip may suddenly suffer catastrophic crack propagation and shatter under pressure forces. This is also a clearly undesirable aspect of a clip with regard to both safety and operational efficiency.

It is an object of the present invention therefore to provide a clip suitable for retaining a fin stabilised projectile in a desired position in a barrel of a launcher such that the projectile is prevented from sliding out of the firing position at angles of approximately −5 to +20 degrees, so resulting in a substantially lower number of misfires than hitherto achieved. It is a further object of the present invention to provide a reusable clip able to consistently withstand the pressure forces associated with firing without shattering or deforming so that it may be reliably re-used.

According to the present invention there is provided a clip for the retention of a fin stabilised projectile in a desired position in a barrel at the rear breech end of a launcher, the clip comprising a generally cylindrical body portion having:

- engagement means for engaging with the launcher at the said rear breech end, said engagement means extending at least part of the way around the said cylindrical body portion and adapted to prevent forward movement of the clip when positioned in the launcher,
- a substantially central axial aperture for allowing access for firing the projectile,
- a plurality of radially and axially extending grooves for engaging the fins of the projectile when the clip is fitted to the projectile, each of said grooves having facing walls defining the groove therebetween, and the grooves adapted to divide the cylindrical body portion into a plurality of connected segments,
- locating means positioned on at least one of said walls of at least one of said grooves and intruding into or above the groove, said locating means adapted to engage positively at least one of the fins of the projectile to prevent the projectile from readily slipping out of the clip when the clip is fitted to the projectile.

The locating means may comprise a locating flange which extends in a generally radial direction. The locating flange may extend along a substantial portion of the radial length of at least one of said walls of said grooves. The locating flange is preferably located at the axial end of the segments furthest from the rear breech end.

The axial lengths of the plurality of connected segments formed by the grooves may not all be the same, and in one embodiment of the invention circumferentially alternate segments are significantly longer in the axial direction than the intermediate segments. Each of the longer alternate segments may have a locating flange on at least one of said walls of said grooves at the axial end furthest from the rear breech end. The locating flange is thereby positioned over the space situated adjacent said longer alternate segments above the adjacent groove.

The axial end of the longer alternate segments furthest from the rear breech end preferably have tapered surfaces in the radial direction, such that the axial length of the longer alternate segments increases towards the axial centre of the clip. Advantageously the longer alternate segments each have one of said locating flanges on each of said walls of said grooves at the axial extremity of the longer alternate segments furthest from the rear breech end. Preferably the tapered surfaces correspond with the axial taper of the fins of the projectile, such that on engagement of the clip with the projectile, the locating flange clips over and positively engages an edge of the projectile fin. The tapered surfaces of the longer alternate segments are adapted to be parallel to a common taper of the projectile having parallel fins when the clip is fitted to the projectile, the locating flange being adapted, when fitted to a projectile, to clip over the edge of the parallel fin of the projectile.

The clip may be manufactured from a flexible material which allows the segments of the body portion to be manipulated for allowing the clip to positively engage the fins of the projectile. In an embodiment having longer alternate segments the spaces adjacent the longer alternate segments adjacent the tapered surfaces are sized such that the longer alternate segments may be readily and temporarily deformed or pulled apart to allow the locating flange to clip over and positively engage the corresponding edge of the projectile fin.

The projectile may be a round of ammunition, for example a bomb or a mortar weapon or a round for an artillery or tank gun, particularly a smooth bore artillery or tank gun.

The engagement means may be a flange portion or rim having a greater diameter than that of the cylindrical body portion and the flange portion or rim may be located substantially at one axial end of the body portion for engagement with a recess located in the barrel of the launcher at the rear breech end. The type of recess may, for example, be as shown in our published patent application number WO93/07439, but will in any event be dimensioned so as to co-operate with the engagement means and position and retain the propellant charge of the projectile in firing proximity to the firing pin of the weapon. The engagement means may comprise a flange portion in the form of a continuous circumferential flange, or a discontinuous flange around the circumference or a number of projections such as pips around the circumference.

Preferably the clip is made from a flexible material having a high coefficient of friction, for example a thermoplastic or hard rubber based material. The material preferably does not suffer from water absorption and does not expand considerably at high temperatures. When exposed to significant forces such as the high pressures experienced during firing, the material is preferably of a type that will undergo plastic deformation rather than experience rapid crack propagation which causes shattering.

The clip may advantageously be made by moulding a material such as polyurethane, for example.

The clip preferably comprises sliding prevention means for preventing the clip and the projectile from sliding backwards towards the rear breech end when loaded into an elevated barrel This may be achieved by having one or more barbs extending outwardly around at least part of the circumference of the body portion. The barbs preferably deflect radially inwards during loading of the clip and projectile but are unable to readily deflect in the opposite direction, and so require a greater force to be applied to cause the clip and projectile to slide backwards towards the breech of the launcher.

Upon firing, the engagement means ensures that the clip remains in the barrel and the locating flange is deformed by the force of the ejecting projectile, which allows the locating flange to disengage from the fin of the projectile. The locating flange may have any convenient cross sectional shape, such as semi circular, which will allow the locating flange on the longer segments to readily and repeatedly deform without damage to the locating flange.

After firing, the clip remains in the barrel from where it may be removed prior to loading the next round. Appropriate finger holes may be moulded into the segments in order to facilitate removal of the clip and also to facilitate positioning the fins of the projectile within the grooves of the clip.

In order the present invention may be more fully understood an example will now be described as a way of illustration only with reference to the accompanying drawings of which:

Figure 1:
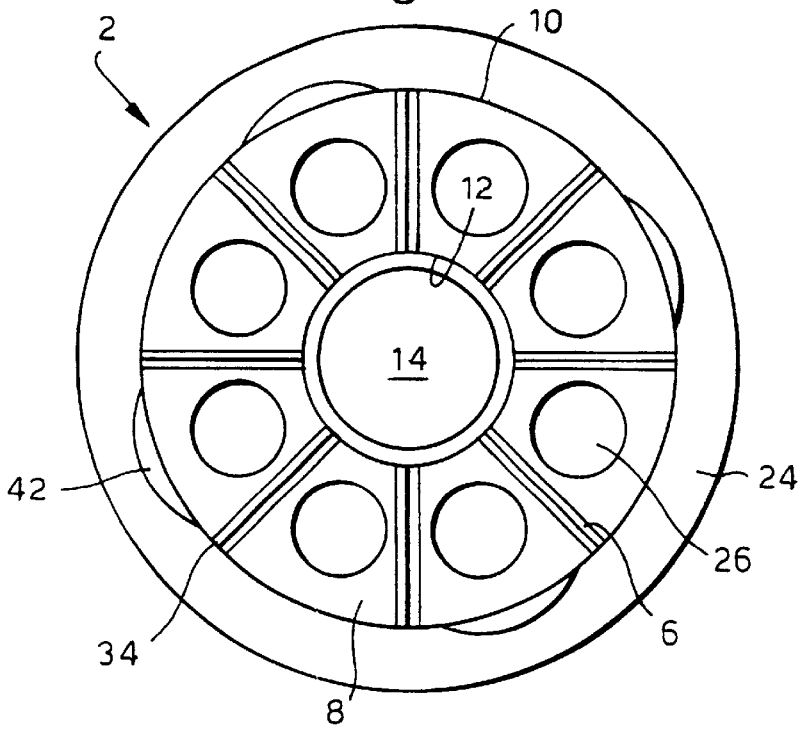
FIG. 1 shows a plan view of a retaining clip of a fin stabilised projectile according to the present invention.
Figure 2:
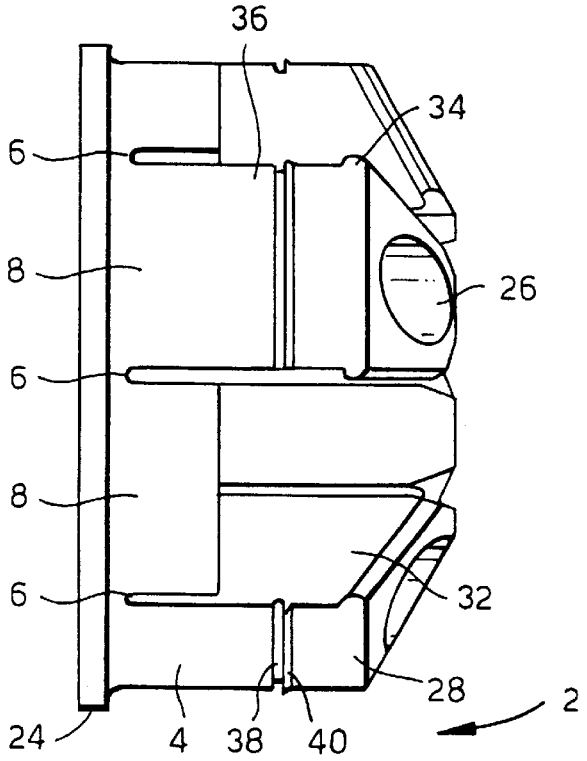
FIG. 2 shows a side view of the clip of FIG. 1.
Figure 3:
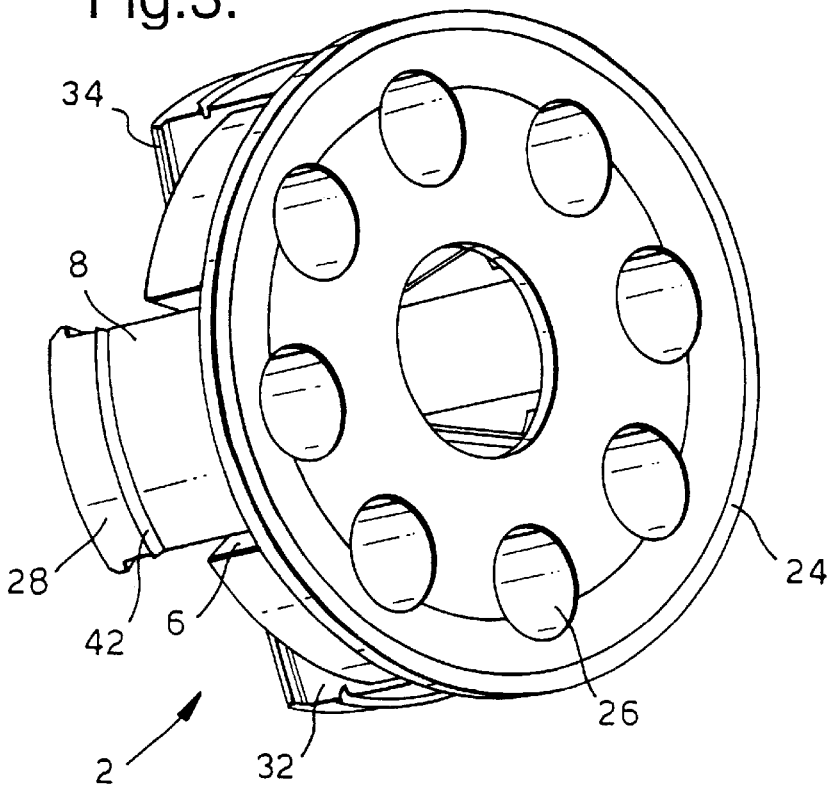
FIG. 3 shows a rear perspective view of the clip of FIGS. 1 and 2.
Figure 4:
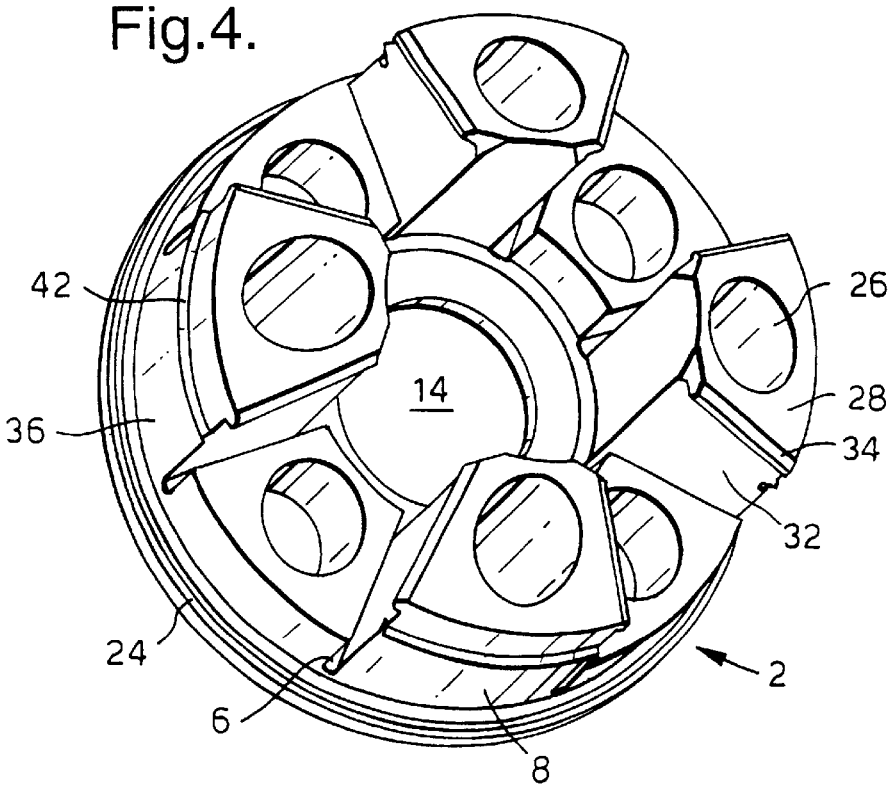
FIG. 4 shows a front perspective view of the clip of FIGS. 1, 2 and 3.

Referring now to the drawings and where the same features are denoted by common reference numerals.

Figure 5:
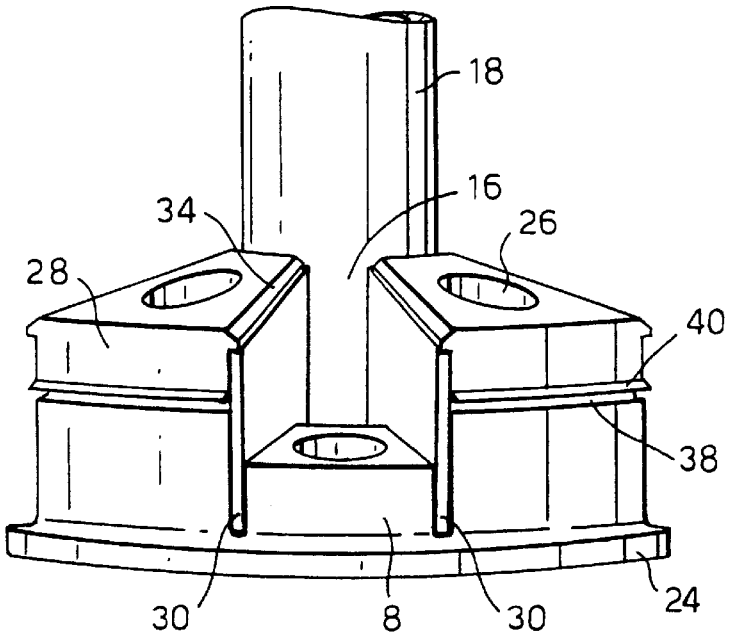
FIG. 5 shows a side view of the clip of FIGS. 1–4 attached to the fins of the projectile.
Figure 6:
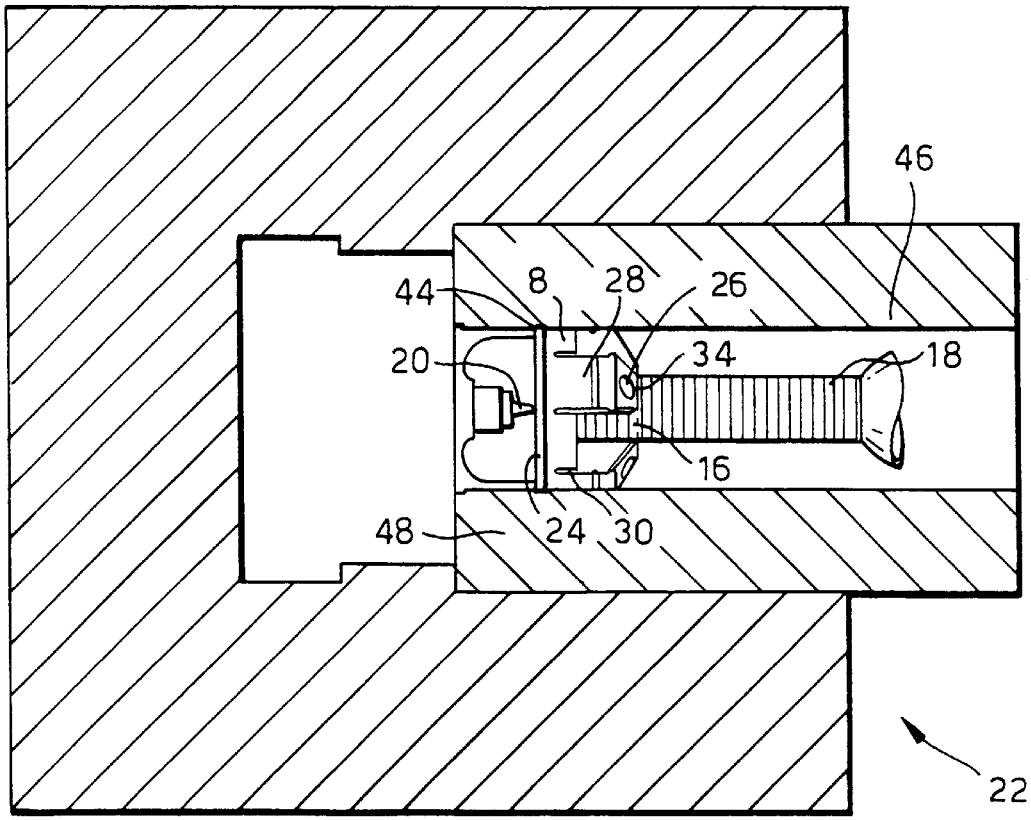
FIG. 6 shows a section through the breech assembly and part of the barrel of the launcher, having a clip attached to a projectile positioned therein.

Referring first to FIGS. 1–4 and where a retaining clip for a fin stabilised projectile is designated generally at 2. The clip comprises a generally cylindrical body portion 4 having radially and axially directed grooves 6 which do not pass the entire axial thickness of the body portion 4. The grooves 6 define the body portion 4 into segments 8 having an outer diameter 10 and an inner diameter 12. The clip 2 has a flange portion 24 substantially at one axial end of the body portion 4. The body portion 4 has a central aperture 14 which allows access to a propellant charge 16 of a projectile 18 by firing pin 20 in the launcher 22 (as shown in FIG. 6) from which the projectile 18 is to be fired. Finger holes 26 are formed in the segments 8 to facilitate both placement of the projectile 18 in the barrel 28 and removal of the clip 2 from the barrel 28 after firing. As shown in FIG. 5, the tail fins 30 of the projectile 18 are held adjacent the walls 32 of the grooves 6. The segments 8 have similar dimensions in the radial and circumferential directions, but have different dimensions in the axial direction. Each segment 8 may be either uniformly axially long or uniformly axially short and are arranged so that segments 8 have alternate axial lengths. The walls 32, which form part of the axially long segments 28 have, adjacent their forward extremity, a radially directed flange 34 which protrudes over the grooves 6. The axially long segments 28 also have, on their outer face 36, a circumferentially extending groove 38 and lip 40, which together comprise a barb 42. As shown in FIG. 5, when the projectile 18 is positioned such that its fins 30 are fitted within the grooves 6, the flange 34 is positioned so as to stop the fin 30 from sliding out of the groove 6 when the barrel 28 of the launcher 22 is depressed. FIG. 6 further illustrates the flange 24 engaging with a recess 44 at the breech end of the barrel 28, the recess 44 having a greater diameter than the remainder of the barrel bore 46. Engagement of the flange 24 with a recess 44 prevents the projectile 18 from sliding forwards when the barrel 28 is depressed. The barbs 42 allow the clip to be pushed forwards during loading into the barrel 28 but prevent the clip 2 and attached projectile 18 from sliding backwards towards the breech end of the barrel 28 at high angles of barrel elevation.

Correct longitudinal positioning within the barrel of the launcher will ensure that the firing pin or other firing means successfully reaches and activates the propellant charge positioned axially at the rear of the projectile. The clip allows a projectile to be correctly located axially in the launcher, ensuring that the propellant charge is readily activated by the firing pin which operates along the axis of the barrel.

In operation and after firing the retaining clip will be retained by the recess 44 at the breech end of the barrel, and is able to be ejected after firing.

What is claimed is:

1. A retaining clip for the retention of a fin-stabilised projectile in a desired position in a barrel at the rear breech end of a launcher, the clip comprising a generally cylindrical body portion having:

engagement means for engaging with the launcher at the said rear breech end, said engagement means extending at least part of the way around the said cylindrical body portion and adapted to prevent forward movement of the clip when positioned in the launcher, a substantially central axial aperture for allowing access for firing the projectile a plurality of radially and axially extending grooves for engaging the fins of the projectile when the clip is fitted to the projectile, each of said grooves having facing walls defining the groove therebetween, and the grooves adapted to divide the cylindrical body portion into a plurality of connected segments locating means positioned on at least one of said walls of at least one of said grooves and intruding into or above the groove, said locating means adapted to engage positively at least one of the fins of the projectile to prevent the projectile from readily slipping out of the clip when the clip is fitted to the projectile.

2. A retaining clip as claimed in claim 1 wherein the said locating means comprises a locating flange which extends in a generally radial direction.

3. A retaining clip as claimed in claim 2 wherein said locating flange extends along a substantial portion of the radial length of at least one of said walls of said grooves, said locating flange being located at the axial end of the said segments furthest from the rear breech end.

4. A retaining clip as claimed in claim 2 wherein the axial lengths of the plurality of connected segments formed by the grooves are not all the same.

5. A retaining clip as claimed in claim 4 wherein circumferentially alternate segments are significantly longer in the axial direction than the intermediate segments.

6. A retaining clip as claimed in claim 5 wherein a number of the longer alternate segments have a locating flange on at least one of said walls of said grooves at the axial end furthest from said rear breech end, the locating flange being positioned over the space situated adjacent said longer alternate segments above the adjacent groove.

7. A retaining clip as claimed in claim 5 wherein the axial end of the said longer alternate segments furthest from said rear breech end have tapered surfaces in a radial direction such that the axial length of the said longer alternate segments increases towards the axial centre of the clip.

8. A retaining clip as claimed in claim 7 wherein the said longer alternate segments each have one of said locating flanges on each of said walls of said grooves at the axial extremity of the longer alternate segments furthest from the rear breech end, and wherein the said tapered surfaces correspond to the axial taper of the fins of the projectile, such that upon engagement of the retaining clip with the projectile, the locating flange clips over and positively engages an edge of the projectile fin.

9. A retaining clip as claimed in claim 8 wherein the said tapered surfaces of the said longer alternate segments are adapted to be parallel to a common taper of the projectile having parallel fins when the clip is fitted to the projectile, said locating flange being adapted, when fitted to a projectile, to clip over the edge of the parallel fin of the projectile.

10. A retaining clip as claimed in claim 1 wherein the clip is manufactured from a flexible material which allows said segments of said body portion to be manipulated for allowing the clip to positively engage the fins of the projectile.

11. A retaining clip as claimed in claim 7 wherein said clip is manufactured from a flexible material and the said spaces adjacent said longer alternate segments adjacent the said tapered surfaces are sized such that said longer alternate segments may be readily and temporarily deformed to allow the said locating flange to clip over and positively engage the corresponding edge of the projectile fin.

12. A retaining clip as claimed in claim 1 wherein said engagement means comprises a flange portion having a greater diameter than that of the cylindrical body portion and located substantially at one axial end of said body portion adapted to engage a recess located in the barrel of the launcher at the rear breech end, when the clip is positioned in the barrel for positioning and retaining the projectile prior to firing.

13. A retaining clip as claimed in claim 1 wherein said engagement means includes a flange portion in the form of a continuous circumferential flange.

14. A retaining clip as claimed in claim 1 wherein said engagement means includes a discontinuous flange around the circumference of said body portion.

15. A retaining clip as claimed in claim 1 wherein said engagement means comprises a plurality of projections around the circumference of said cylindrical body portion.

16. A retaining clip as claimed in claim 1 wherein said clip is made from a flexible material having a high coefficient of friction, a low coefficient of thermal expansion and substantially impermeable properties.

17. A retaining clip as claimed in claim 16 wherein said flexible material is a thermoplastic material.

18. A retaining clip as claimed in claim 16 wherein said flexible material is a hard rubber based material.

19. A retaining clip as claimed in claim 16 wherein said flexible material undergoes plastic deformation when exposed to high pressures during firing of a projectile.

20. A retaining clip as claimed in claim 1 wherein said clip is made by moulding.

21. A retaining clip as claimed in claim 1 wherein said clip is made from polyurethane.

22. A retaining clip as claimed in claim 1 wherein said clip comprises sliding prevention means for preventing the clip and the projectile from sliding backwards towards the rear breach end when loaded in the barrel.

23. A retaining clip as claimed in claim 22 wherein said sliding prevention means comprises at least one barb extending circumferentially around at least part of the circumference of said body portion.

24. A retaining clip as claimed in claim 23 wherein said at least one barb extends outwardly from the circumference of the body portion and is adapted to allow the clip readily to be moved forwards away from the rear breech end during loading of the clip and the projectile, but which offers friction resistance to rearward movement of the clip.

25. A retaining clip as claimed in claim 2 wherein said locating flange is adapted to be deformed by the force of an ejecting projectile to allow said locating flange to disengage from the fin of a projectile.

26. A retaining clip as claimed in claim 25 wherein said locating flange is capable of readily and repeatedly deforming without damage to itself.

27. A retaining clip as claimed in claim 1 wherein at least one finger hole is moulded into at least one segment for facilitating removal of said clip from the barrel of the launcher and for further facilitating positioning of the fins of the projectile within the grooves of the clip.

* * * * *

UNITED STATES PATENT AND TRADEMARK OFFICE

CERTIFICATE OF CORRECTION

PATENT NO. : 6,272,997 B1
DATED : August 14, 2001
INVENTOR(S) : James et al.

It is certified that error appears in the above-identified patent and that said Letters Patent is hereby corrected as shown below:

Title page,
-- Related U.S. Application Data

[63] Continuation of application No. PCT/GB99/01322, filed on April 28, 1999.

[30] Foreign Application Priority Data
May 1, 1998 (GB) 98093297.7 --

Signed and Sealed this

Eleventh Day of June, 2002

*Attest:*

*Attesting Officer*

JAMES E. ROGAN
*Director of the United States Patent and Trademark Office*